United States Patent [19]

Shields

[11] Patent Number: 4,682,925

[45] Date of Patent: Jul. 28, 1987

[54] TACK STRIP

[75] Inventor: Thomas A. Shields, Bourne, Mass.

[73] Assignee: USM Corporation, Farmington, Conn.

[21] Appl. No.: 722,152

[22] Filed: Apr. 11, 1985

[51] Int. Cl.[4] ..... F16B 15/00; A47G 27/04

[52] U.S. Cl. ..... 411/461; 52/548; 16/16

[58] Field of Search ..... 411/443, 445–447, 411/477, 478, 466, 461, 921, 84, 85, 175; 16/4, 6, 7, 16; 24/265 A; 52/548, 551

[56] References Cited

U.S. PATENT DOCUMENTS

| | | | |
|---|---|---|---|
| 1,052,617 | 2/1913 | Norman | 16/16 |
| 1,260,438 | 3/1918 | Orewiler | 24/265 A |
| 1,990,776 | 2/1935 | Dexter | 52/548 |
| 2,051,191 | 8/1936 | Watson | 411/461 |
| 2,176,344 | 10/1939 | Hunt | 52/548 |
| 2,896,294 | 7/1959 | Cheney | 24/265 A |
| 3,683,738 | 8/1972 | Kyriakos | 16/16 |

*Primary Examiner*—Gary L. Smith

*Assistant Examiner*—Neill Wilson

*Attorney, Agent, or Firm*—Thomas S. Szatkowski

[57] ABSTRACT

A tack strip for securing upholstery fabric to a frame structure comprising a strip of flexible metal having a longitudinally extending fold line forming upper and lower angularly disposed flanges. The lower flange has a continuous edge and a plurality of equally spaced openings separated by a solid flange portion. The openings are spaced to receive a staple that is adapted to secure the solid portion and thus the lower flange to the frame structure. The upper flange has a plurality of equally spaced slots extending to the fold line in the area of the lower flange openings. The slots form a plurality of spaced tabs in the upper flange, each tab having outwardly and downwardly extending prongs facing the lower flange. The fabric is adapted to be placed over the tabs and pressed onto the prongs. The tabs are then bent over to sandwich the fabric between the flanges, with the prongs being bent back toward the tabs and coacting with the staple to securely retain the fabric to the frame structure.

1 Claim, 3 Drawing Figures

TACK STRIP

BACKGROUND OF THE INVENTION

1. Field of the Invention

This invention relates to tack strips for use in securing upholstery to the frame work of furniture.

2. Summary of the Prior Art

In the manufacture and repair of furniture, it is desirable to use a tack strip type fastening device to secure the margins of the upholstery material or fabric to the framework of the furniture. This is accomplished by providing a continuous flexible non-resilient metal strip with a longitudinally extending fold to provide two longitundinally extending angularly disposed flanges. The lower flange is perforated for attachment in a flat condition to the surface of the furniture framework. The upper flange has a series of sharp prongs protruding from its surface; the prongs being adapted to engage the upholstery fabric. With the upper flange flattened against the framework, the fabric is secured and the tack strip is concealed under the fabric.

An example of a tack strip of this type is illustrated in U.S. Pat. No. 3,008,173. The upper flange of this latter type of tack strip is designed with the prongs facing outwardly so that the upper flange is folded away from the lower flange when flattened against the framework. This requires the user to judge the required spacing for the strip to be offset from the margin of the framework against which the fabric must be matched so that the upper flange places the material along the edge of the framework.

A more desirable approach to the tack strip is illustrated in U.S. Pat. Nos. 2,051,191 and 3,683,738 which have the prongs facing inwardly so that the fabric is sandwiched in between the strip flanges as the upper flange is folded over the lower flange. In these types of devices, the outer edge of the lower flange can be placed along the margin of the framework thus making it much easier for the user to match the fabric to the margin of the framework.

In the above mentioned devices however the lower flange does not have a plurality of equally spaced slots with solid flange portions adapted to support a staple (which is the current desirable manner of securing the flange to the framework).

Also, the lower flange of the prior art strips are lanced so that the strip can be placed along a sensuous contour which makes the entire strip too flexible to be easily placed along the straight edge of the back of a chair, for example. Additionally, it is desirable to angularly dispose the prongs toward the face of the lower flange to assure that the prongs grip the fabric and bend inwardly toward the upper flange face to securely attach the fabric along the surface of the upper flange.

BRIEF SUMMARY OF THE INVENTION

It is an object of this invention to provide a tack strip for securing upholstery fabric to the marginal edge of the framework of furniture. The tack strip comprises a flexible metal strip longitudinally folded to form a lower flange and an upper flange. The lower flange has a continuous surface with equally spaced longitudinal slots for receipt of staples to secure the lower flange to the desired edge area of the furniture framework. The upper flange has a plurality of spaced prongs angularly protruding from the surface of the upper flange. The fabric is placed over the upper flange and pressed onto the prongs and the upper flange is then folded over the lower flange to sandwich fabric between the flange of the strip. The prongs protrude into the fabric and form back into the surface of the upper flange to securely grip the fabric when the fabric is sandwiched between the flanges.

It is a further object of the invention to provide the lower flange of the tack strip with a continuous uninterrupted straight outer edge so that the tack strip can be easily placed along the straight marginal edge of furniture framework, such as along the marginal back edges of chairs.

DESCRIPTION OF THE PREFERRED EMBODIMENT

Figure 3:
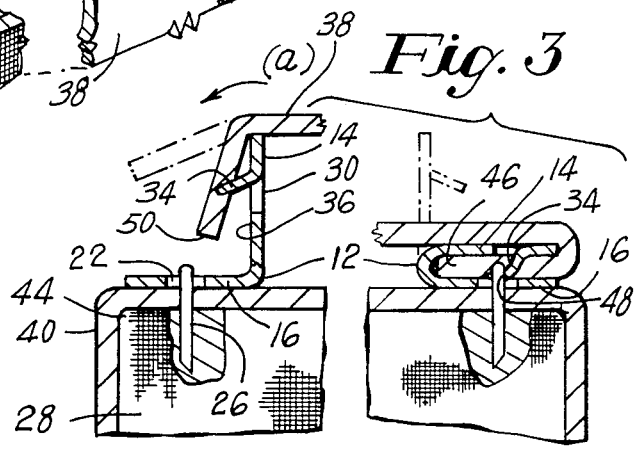
FIG. 3 is a sectional view of the tack strips in various positions of application of the fabrics to the furniture frame.

The tack strip in accordance with the invention is formed from a strip of flexible non-resilient metal 10 folded along a longitudinal central fold line 12 to form upper and lower flanges 14 and 16, respectively. The flanges 14 and 16 are disposed at approximately 90° to one another as illustrated in FIG. 3.

The lower flange 16 has a continuous uninterrupted outer edge 18 which maintains the strip 10 in a straight line throughout its longitudinal extent. This permits the strip 10 to be aligned with the straight marginal edge of the back of a furniture frame, as become apparent hereinafter. Formed in the surface 20 of strip 10 is a plurality of equally spaced elongated openings 22 separated by solid portions 24 of the flange 16. This permits a staple 26 to be inserted into the openings 22 and across the solid portions 24 to secure the strip 10 to the furniture frame 28 (see FIGS. 2 and 3).

The upper flange 14 comprises a plurality of separate tab members 30 spaced apart by slots 32 which extend downward to the fold line 12 in the area of the openings 22. Each of the tab members 30 contain aligned prongs 34 which are formed out of the surface 36 of the tab members 30. The prongs 34 are disposed at an angle to the surface 36 of the tab members 30 in the direction of lower flange 16, as illustrated in FIG. 3.

Figure 1:
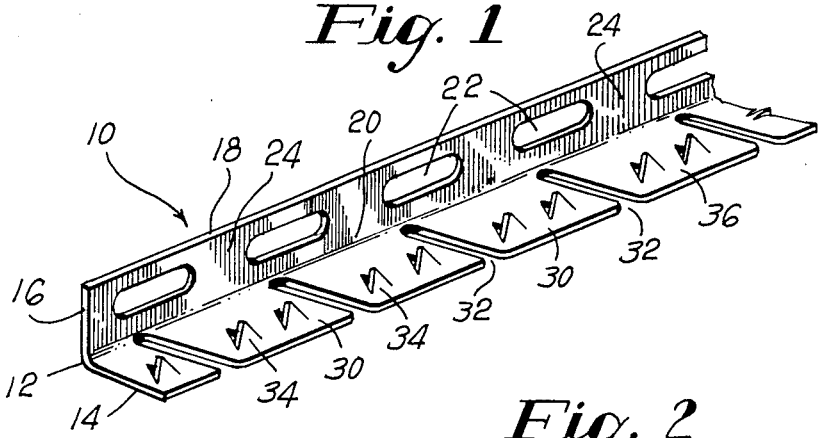
FIG. 1 is a perspective view of the tack strip of this invention.

The slots 32 by forming separate individual tab members 30 in the upper flange 14, not only assist in forming the fabric to the tack strip, but also facilitate the storage of a substantial length of the strip. In practice, the strip can be rolled into a reel about the lower flange 16. With the lower flange 16 disposed upwardly, (see FIG. 1), the strip can be formed into a reel of material since the tab members 30 are separated by slots 32. This permits placing a substantial length of the tack strip into a reel for storage and shipment. At the same time, the outer edge 18 of lower flange 16 will remain straight and as the strip 10 is unreeled and sections cut to length for use, the lower flange 16 can be straightened and securely fastened to the frame 28 in a flat condition, as illustrated in FIG. 2.

Figure 2:
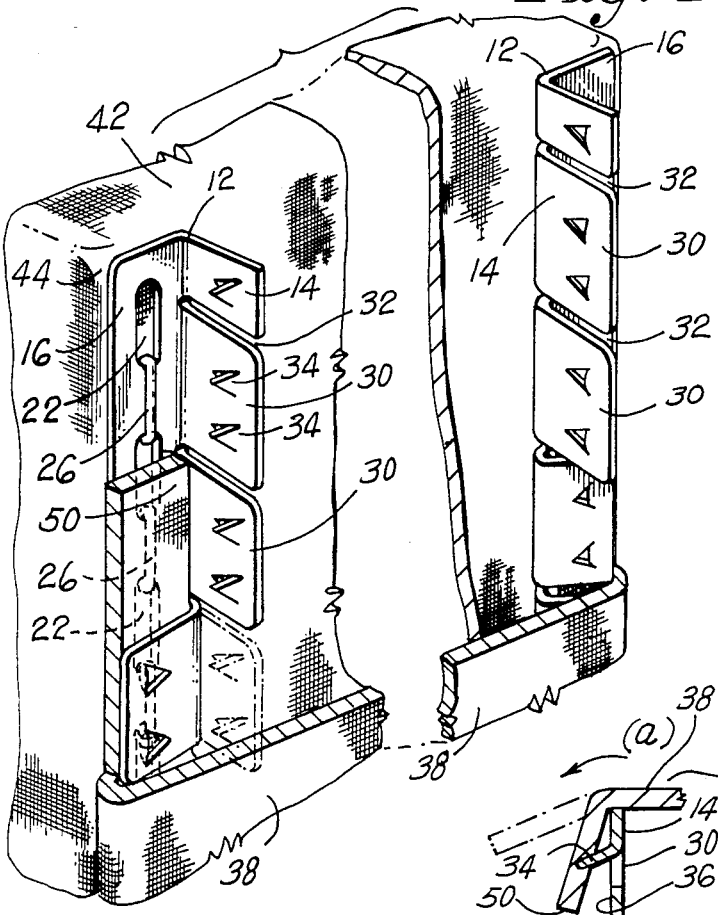
FIG. 2 is a perspective view of tack strips applied to opposite sides of the straight back of a piece of furniture.

Attention is now directed to FIGS. 2 and 3 which illustrate the manner in which the tack strip 10 is used to secure a fabric 38 to the frame 28. Initially, a front fabric 40 is secured around the back area 42 of a furniture frame. Thereafter, the outer edge 18 of strip 10 can be placed along the marginal edge 44 of the frame and by the insertion of staples 26 across portions 24, the lower flange 16 is secured along the straight back area 42 of the frame 28.

After the installation of the strip 10 to frame 28, the edge 46 of back fabric 38 can be placed over flange 14 and inserted onto the prongs 34. The user can then progressively hammer over the tab members 30 about fold 12 to sandwich the edge 46 of fabric 38 between the flanges 14 and 16 of strip 10 (see FIG. 3). As the tab members 30 are forced over on the lower flange 16, the ends 48 of the prongs 34 will abut the surface 24 of flange 16 and bend back toward the surface 36 of flange 14 to securely grip the fabric 38 against the surface 36 of flange 14 in the direction of pull on the fabric 38. Further, the ends 48 of prongs 34 will abut the surface 24 in the area of the staple 26 (see FIG. 3) to pinch the fabric against the staples to further grip the material (see FIG. 3) against the direction of pull on the fabric.

After the application of one edge 46 of the material 38 to the tack strip 10, as illustrated in FIG. 3, the opposed edge 50 of fabric 38 can be trimmed and folded over the tab members 30 of upper flange 14 and pressed onto the prongs 34. Thereafter, the tab members 30 can be progressively hammered over fold 12 and against the lower flange 16. As the tab members 30 are bent over an arc (a), the fabric 38 will be pulled taut along the back of the piece of furniture. As the tab members 30 are forced against the lower flange 16, the prong ends 48 will likewise be bent back into he surface 36 of the tab members 30 to securely grip the fabric against the surface 36 of the flange 14. Further, with the prong ends 48 entering into the area of the staples 26, the fabric will be securely gripped between the flanges 14, 16 of the tack strip 10. It can thus be seen, that with the completion of the installation, the staples 26 and the tack strip will be completely hidden beneath the surface of the fabric 38.

The tack strip of this invention provides an easy and convenient way for the user to secure fabric along a straight frame line while upholstering furniture. With the provision of spaced elongated openings 22, the strip 10 can be readily attached to the frame 28 by presently conventional means of heavy duty staples. Further, with the provision of spaced tab members, the strip can be rolled into the reel for storage. Also, the spaced tab members 30 can be progressively hammered over when securing the fabric between the upper and lower flanges 14 and 16 of the strip 10. This permits the user to accurately guide the fabric 38 along the strip when the tab members are bent over onto the flange 16.

It should also be noted that the prongs 34 are disposed at an angle to the surface 38 of flange 14 so that the ends 48 of prongs 34, when contacting the surface 24 of flange 16, will bend back into the surface 36 of flange 14 to securely attach the fabric 38 to surface 36 against the direction of pull on the fabric to maintain the fabric taut. Attention is also directed to the fact that the spacing of prongs 34 from fold 12 is approximately equal to the spacing of openings 22 from the fold so that as the prongs 34 are placed against the flange 16, the prongs 34 are in the area of staples 26 which will pinch the fabric between the prongs 34 and staple 26 to further grip the fabric to the tack strip.

I claim:

1. A tack strip for securing upholstery fabric to an underlying frame structure comprising:

a. a strip of flexible metal material having a longitudinally extending centrally located fold forming upper and lower angularly disposed flanges;

b. said lower flange having a continuous straight edge portion adapted to be aligned with a straight marginal edge of the frame structure;

c. said lower flange also including a plurality of equally spaced elongated openings along the longitudinal extend to said lower flange with spaced solid portions of said lower flange therebetween; said openings adapted to receive a staple fastener to secure said spaced solid portions and thus said lower flange to the frame structure;

d. said upper flange having a plurality of equally spaced slots extending to said fold to form a plurality of spaced tab members therebetween; each of said tab members having a width substantially greater than the width of the spacing therebetween and having spaced prongs;

e. said prongs being formed out of the surface of said tab members toward said lower flange, the fabric being adapted to be placed over said tab members and gripped by said prongs; said tab members being adapted to be progressively formed about said fold against said lower flange to sandwich the fabric between said upper and lower flanges of the tack strip; and, f. said prongs being angularly disposed out of the surface of said tab members in the direction of said fold so that upon forming said tab members about said fold, said prongs will abut the surface of said lower flange and form back toward the surface of said tab members to securely attach the fabric against the surface of said tab members;

g. and wherein the spacing of said prongs from said fold is approximately equal to the spacing of said openings from said fold so that said prongs will interlock with the staple to pinch the fabric therebetween.

* * * * *